US006166341A

United States Patent [19]

Dawson

[11] Patent Number: 6,166,341

[45] Date of Patent: Dec. 26, 2000

[54] DUAL CROSS EDGE CONTACTS FOR LOW ENERGY SWITCHES

[75] Inventor: Arthur Wayne Dawson, Freeport, Ill.

[73] Assignee: Honeywell INC, Morristown, N.J.

[21] Appl. No.: 09/405,193

[22] Filed: Sep. 24, 1999

[51] Int. Cl.[7] ..... H01H 1/06

[52] U.S. Cl. ..... 200/279

[58] Field of Search ..... 200/275, 279, 200/283, 405–409, 445, 447–449, 451, 453, 454, 456, 458, 460–467

[56] References Cited

U.S. PATENT DOCUMENTS

| | | | |
|---|---|---|---|
| 3,573,812 | 4/1971 | Pihl | 340/373 |
| 3,819,896 | 6/1974 | Aidn et al. | 200/166 J |
| 4,129,763 | 12/1978 | Murata | 200/159 A |
| 4,163,125 | 7/1979 | Boulanger | 200/5 A |
| 4,216,358 | 8/1980 | Brozille | 200/67 D |
| 4,220,835 | 9/1980 | Storz et al. | 200/67 DB |
| 4,644,115 | 2/1987 | Nishimori et al. | 200/67 D |
| 5,422,451 | 6/1995 | Herklotz | 200/269 |
| 5,712,611 | 1/1998 | Mates et al. | 337/334 |
| 5,818,002 | 10/1998 | Kurtz et al. | 200/834 |

*Primary Examiner*—Michael Friedhofer
*Attorney, Agent, or Firm*—Kris T. Fredrick

[57] ABSTRACT

A low energy switch contact design uses a flat spring moveable contact with contact portions made from the sides of the spring bent ninety degrees from the main spring body so as to make point contact with a stationary contact edge located either above or below the moveable contact. The spring is preferably bifurcated for redundancy of contact.

6 Claims, 2 Drawing Sheets

DUAL CROSS EDGE CONTACTS FOR LOW ENERGY SWITCHES

BACKGROUND OF THE INVENTION

1. Field of the Invention

The present invention relates generally to low energy mechanical switches. The invention relates more specifically to contact designs for those switches.

2. Description of Prior Art

Mechanical switching at low energy, i.e. transferring low currents at low voltages, for example to avoid sparking, is often problematic. Low current is generally meant to include the range of 0.001 to 0.050 amp. The low current does not provide sufficient energy, or spark, at the contacts to burn away contaminants thereon.

Contaminant build up will occur unless physical cleaning of the contact point takes place during the time the moveable contact comes into contact with the stationary contact. This physical cleaning is called wiping. Also, troughing of the contact point, wherein a groove is formed in the mating surfaces, may occur on one or both contact surfaces. Troughing causes loss of wiping action when the movable contact makes contact with the stationary contact. Loss of wiping means contaminants will not be moved away from the contact area, resulting in less efficient current flow. Troughing also changes switch mechanics, causing operate point variability and, at the extreme, can result in mechanical interlock and loss of switch function.

Therefore, it would be desirable to have a switch design which can retain good electrical contact characteristics while operating at low energies.

SUMMARY OF THE INVENTION

The present invention discloses a design for electrical contacts in an electromechanical switch which is very useful for low energy applications. The design provides edge-to-edge contact, or point contact, between the edge of the moveable contact and the edges of the stationary contacts.

The moveable contact is disclosed as a bifurcated snap spring member having bent portions perpendicular to the main body of the spring member in order to present an edge, or line, of contact to the stationary normally closed and normally open contacts. The stationary contacts also present a contact line, or edge, to the moveable contact and are therefore preferably wedge shaped or the like.

The point contact provided produces two small, wiping, points of contact which maximize contact force and self cleaning of the contact area.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
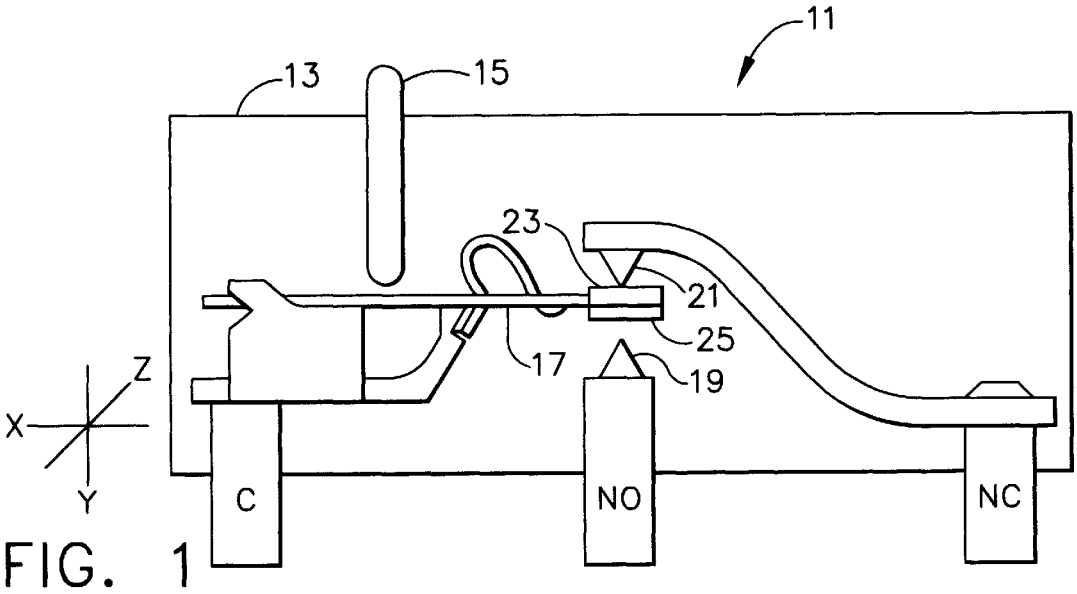
FIG. 1 shows a snap spring switch according to the preferred embodiment of the invention.

Referencing FIG. 1, a snap switch 11 is shown as a single pole double throw (SPDT) switch with a case 13; plunger 15; a snap spring, moveable, common contact 17; and normally open and normally closed stationary contacts 19, 21 respectively.

The moveable contact 17 has at least one contact edge for each stationary contact it meets. In the view of FIG. 1, the moveable contact 17 possesses an upper edge 23 for contacting the normally closed stationary contact 21; and a lower edge 25 for contacting the normally open stationary contact 19.

Figure 2:
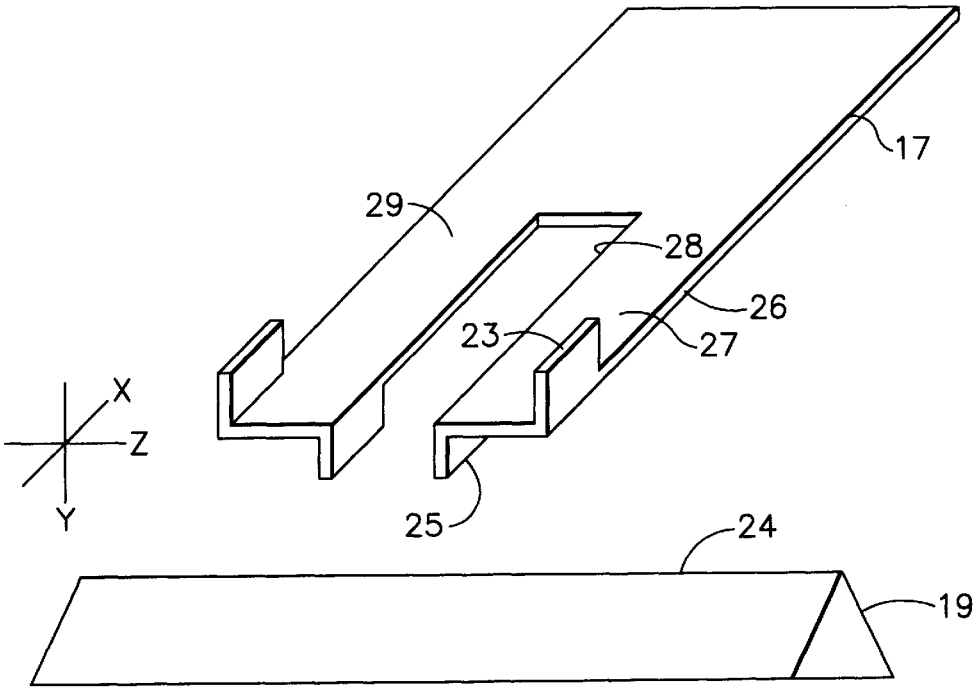
FIG. 2 is a detail perspective view of contacts according to the preferred embodiment.
Figure 3:
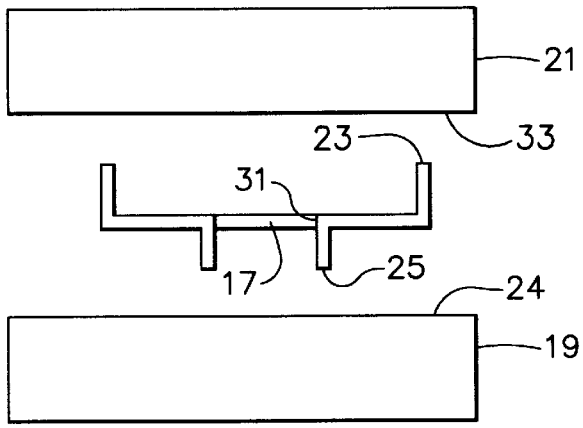
FIG. 3 is a front view of the moveable and two stationary contacts.

Referencing FIGS. 2 and 3, the moveable contact 17 is seen as a bifurcated member having first and second fingers 27, 29 respectively, for making redundant contact by the stationary contact 19. As the fingers are essentially mirror images only one will be described for convenience, it being understood that the two mirror image fingers 27, 29 are preferred for redundant contact and symmetrical force loading. The stationary contact 19 is a wedge shaped bar presenting an edge, or line, of contact 24 to the fingers 27, 29.

At the end of the fingers 27, 29 proximal to the stationary contact 21, a finger 27 has a portion of its metal, along an outside edge of the first long side 26 of the finger, bent perpendicular to the plane of the moveable contact 17 so as to present its upper edge 23 as a line contact with the contact edge 33 of the stationary contact 21. The edge-to-edge, or line-to-line, contact produces a point of contact for each finger 27, 29 when the moveable contact 17 touches the stationary contact. This design maximizes contact force at the contact points and each point of contact is allowed to wipe as the stationary contact bends, thereby maximizing cleaning action.

Referencing FIG. 3, a contact member on the finger 27 for contacting the normally open stationary contact 19, is produced on an inside edge of a second long side 28 of the finger by a perpendicular bend of edge material in the direction of the stationary contact 19. The bend produces a lower edge of contact 25 for meeting the edge, or contact line, 24 of the wedge shaped stationary contact 19. In this manner each of the circuit configurations of the switch 11 are produced with redundant, or two point, contacts with good contact force and wiping action.

Figure 4:
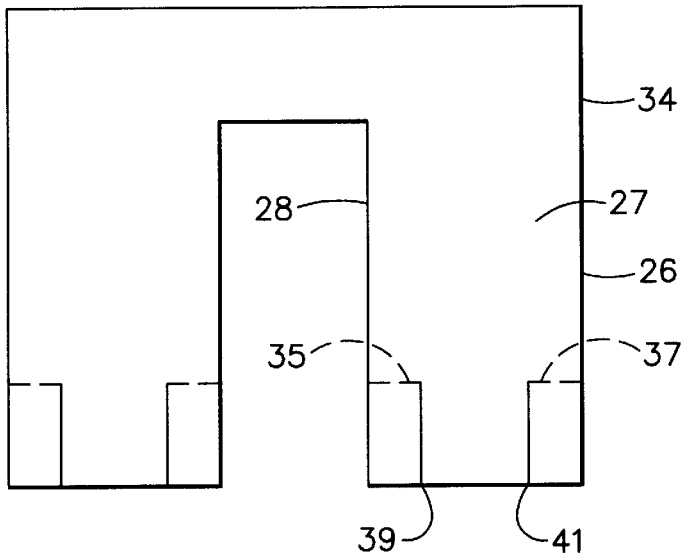
FIG. 4 is a cut and fold diagram illustrating one method of making the bifurcated spring contacts.
Figure 5:
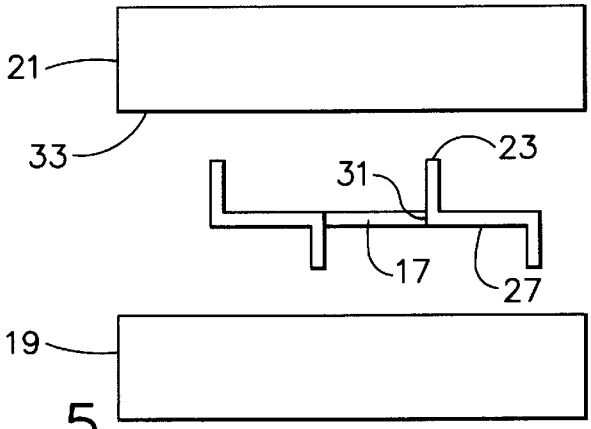
FIG. 5 is an alternative embodiment to that of FIG. 2.

Referencing FIG. 4, a simple method of producing contacts of the present invention on the bifurcated moveable contact is illustrated. From a known flat bifurcated moveable contact 34 one can simply make two cuts 35, 37 on each finger perpendicular to the long axis of the finger 27, and extending from the long sides, or edges 26, 28, of the fingers a preselected distance towards the midline. At fold lines 39, 41 parallel to the long axis one bends the metal portion, freed from the finger edge by the cut 37, in a first direction perpendicular to the main body of the finger, and bends the metal portion freed by the cut 35 in a second perpendicular direction opposite the first perpendicular direction. It will be appreciated that the two fingers may have identical bends, as in FIG. 5, or minor image bends, as in the preferred embodiment.

While the invention has been described in terms of a preferred embodiment, many variations within the scope of the present invention may become apparent to the artisan of ordinary skill. The invention is intended to be limited only by the appended claims.

I claim:

1. A movable contact member for a snap switch comprising:

a. a movable contact member placed between stationary contacts and having a flat main body with a bifurcation producing two fingers, each of the fingers having a first contact portion bent perpendicular from the main body in a first direction;

and each of the fingers having a second contact portion bent perpendicular from the main body in a second direction.

2. A contact arrangement for a snap switch comprising:

a. first and second stationary contact members each having an edge for contacting a moveable contact member placed therebetween;

b. the movable contact member placed between said stationary contacts with the moveable contact member having a first contact portion bent perpendicular from the main body in a direction toward the first stationary contact and presenting a contact edge toward the first stationary contact edge and orthogonal thereto;

c. the movable contact member having a second contact portion bent perpendicular from the main body in a direction toward the second stationary contact and presenting a contact edge toward the second stationary contact edge and orthogonal thereto;

whereby the moveable contact member contacts each of said stationary contacts with a line-to-line contact point.

3. A contact arrangement for a snap switch comprising:

a. first and second stationary contact members each having an edge for contacting a moveable contact member placed therebetween;

b. the movable contact member placed between said stationary contacts with the moveable contact member having two contact portions bent perpendicular from the main body in a direction toward the first stationary contact and presenting two contact edges toward the first stationary contact edge and orthogonal thereto;

c. the moveable member having two contact portions bent perpendicular from the main body in a direction toward the second stationary contact and presenting two contact edges toward the second stationary contact edge and orthogonal thereto;

whereby, the moveable contact member contacts each of said stationary contacts with two line-to-line contact points.

4. A contact arrangement for a snap switch comprising:

a. first and second stationary contact members each having an edge for contacting a moveable contact member placed therebetween;

b. the movable contact member placed between said stationary contacts and having a flat main body with a bifurcation producing two fingers, each of the fingers having a first contact portion bent perpendicular from the main body in a direction toward the first stationary contact and presenting a contact edge toward the first stationary contact edge and orthogonal thereto;

c. each of the fingers having a second contact portion bent perpendicular from the main body in a direction toward the second stationary contact and presenting a contact edge toward the second stationary contact edge and orthogonal thereto;

whereby, the moveable contact member contacts each of said stationary contacts with two line-to-line contact points.

5. A switch comprising:

a. first and second stationary contact members each having an edge for contacting a moveable contact member placed therebetween;

b. the movable contact member placed between said first and second stationary contacts for alternate contact therewith, and having a flat main body with a bifurcation producing two fingers, each of the fingers having a first contact portion bent perpendicular from the main body in a direction toward the first stationary contact and presenting a contact edge toward the first stationary contact edge and orthogonal thereto;

c. each of the fingers having a second contact portion bent perpendicular from the main body in a direction toward the second stationary contact and presenting a contact edge toward the second stationary contact edge and orthogonal thereto;

d. whereby the moveable contact member contacts each of said stationary contacts with two line-to-line contact points;

e. a plunger for moving the moveable contact between contact with the first stationary contact and the second stationary contact; and f. a case for enclosing said contacts and a portion of said plunger.

6. A single pole double throw snap switch comprising:

a. first and second stationary contact members each having an opposing edge in the Z axis for contacting a moveable contact member placed therebetween;

b. the moveable contact member placed between said first and second stationary contacts for alternate contact therewith, and having a flat main body lying substantially parallel to the X-Z plane with a bifurcation producing two fingers, each of the fingers having a first contact portion substantially parallel to the X-Y plane and bent perpendicular from the main body in a direction toward the first stationary contact and presenting a contact edge along the X axis toward the first stationary contact edge and orthogonal thereto;

c. each of the fingers having a second contact portion substantially parallel to the X-Y plane and parallel to the first contact portion and bent perpendicular from the main body in a direction toward the second stationary contact and presenting a contact edge along the X axis toward the second stationary contact edge and orthogonal thereto;

d. whereby the moveable contact member contacts each of said stationary contacts with two line-to-line contact points;

e. a plunger for moving the moveable contact between contact with the first stationary contact and the second stationary contact; and f. a case for enclosing said contacts and a portion of said plunger.

* * * * *